United States Patent [19]

Stohlquist

[11] 4,259,827

[45] Apr. 7, 1981

[54] PACKAGING APPARATUS

[75] Inventor: Roger H. Stohlquist, Rockford, Ill.

[73] Assignee: Anderson Bros. Mfg. Co., Rockford, Ill.

[21] Appl. No.: 92,705

[22] Filed: Nov. 9, 1979

[51] Int. Cl.[3] ..... B65B 43/28; B31B 17/74

[52] U.S. Cl. ..... 53/564; 53/284; 493/102; 493/114; 493/183; 493/313

[58] Field of Search ..... 53/564, 281, 284; 93/39.1 P, 55.1 R, 55.1 M, 55.1 P

[56] References Cited

U.S. PATENT DOCUMENTS

| | | | |
|---|---|---|---|
| 2,612,016 | 9/1952 | Anderson | 53/56 |
| 3,172,435 | 3/1965 | Anderson et al. | 141/131 |
| 3,298,288 | 1/1967 | Anderson et al. | 93/53 |
| 3,364,651 | 1/1968 | Stohlquist | 53/266 |
| 3,739,695 | 6/1973 | Peacock | 93/55.1 R X |

*Primary Examiner*—Travis S. McGehee
*Attorney, Agent, or Firm*—Morsbach & Pillote

[57] ABSTRACT

A packaging apparatus for erecting, filling and closing paperboard cartons of a type that are initially supplied in a flattened condition and have four body panels, lower closure flaps; and an open top, and a separate plastic cover. The packaging apparatus opens and erects the paperboard cartons in an inverted position and advances the cartons while inverted along a path past a filling station. Covers are fed to a position below the cartons and are pressed into the open ends of the cartons as they are advanced along the path and before they reach the filling station. The lower closure flaps are thereafter folded to close the cartons.

12 Claims, 16 Drawing Figures

6
7
121
23
21
33
22
33c
33b
S1
90
75
90a
81
70
25
71
96
93b
96
33a
101
103
70
79
72
73
93a
C
87
85
91
93
94
80
24
3
6
7
3

PACKAGING APPARATUS

Packaging apparatus have heretofore been made, for example as shown in U.S. Pat. Nos. 2,612,016; 3,172,435; 3,298,288 and 3,364,651 for packaging material in cartons which are initially supplied in a flattened condition and have four body panels interconnected along fold lines to form a rectangular body and top and bottom closure flaps interconnected along fold lines to the upper and lower ends of the four body panels for closing the upper and lower ends of the carton. In general, the packaging apparatus disclosed in the aforementioned patents were arranged to set up or erect such cartons at a carton set-up station and then advance the cartons in step fashion past a lower flap folding station where the lower flaps were folded to close the lower end of the carton, a filling station where the cartons were filled, and a top carton closing station where the flaps on the upper end of the carton were infolded to close the top of the carton.

The present invention relates to improvements in packaging apparatus for erecting, filling and closing cartons that are initially supplied in a flattened condition and have four body panels interconnected along fold lines to form a rectangular carton body having an open top, bottom closure flaps interconnected along fold lines at the lower ends of the four body panels for closing the bottom of the carton body, and a separate plastic cover of rectangular configuration for closing the open top of the carton body.

The present invention provides, in a packaging apparatus of the type having a filling station, spaced lateral carton guides for guiding carton bodies along a linear path past the filling station, conveyor means operative to advance carton bodies along the path from a carton infeed station adjacent one end of the lateral carton guides and past the filling station to a delivery station, a carton infeed mechanism adjacent one end of the lateral carton guides for supporting a stack of flattened carton bodies, and carton feed means operated in timed relation with the conveyor means for withdrawing a flattened carton body from the carton magazine and for opening the carton body and for depositing the open carton body at the carton infeed station, the improvement wherein the carton magazine and carton infeed mechanism are arranged to deposit the carton bodies at the infeed station with the body inverted to have its open end lowermost, a cover magazine adjacent said one end of the lateral carton guides for supporting a stack of covers, means operated in timed relation with the conveyor means for feeding a cover from the cover magazine to a cover infeed station at a level below the carton infeed station, cover applying means operated in a timed relation with the conveyor means for moving a cover from its cover infeed station and into the open end of a carton body to close the same as the carton body is advanced by the conveyor means away from the carton infeed station toward the filling station, and means disposed above the path for folding and closing the carton bottom closure flaps as the cartons are advanced by the conveyor means from the filling station to the delivery station.

In packaging apparatus in which the conveyor means comprise a reciprocating type transfer means for advancing the cartons, the cover feed and applying means advantageously includes a slide mounted for reciprocation in timed relation with the packaging machine transfer means to feed covers from the cover magazine and to apply the covers to the open ends of the cartons as they are advanced by the packaging machine transfer means.

The covers are advantageously crimped to the carton after they are applied thereto and before filling of the cartons.

These, together with other features and advantages of this invention will be more readily understood by reference to the following detailed description, when taken in connection with the accompanying drawing wherein.

Figure 15:
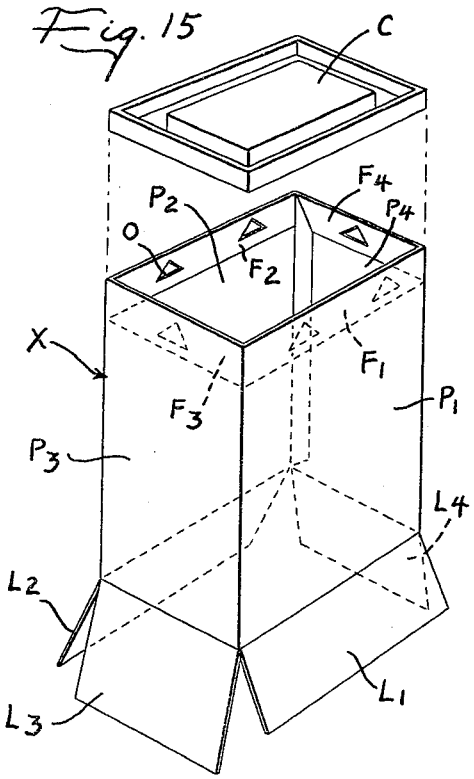
FIG. 15 is an exploded perspective view of the carton and cover utilized for forming packages on the packaging apparatus.
Figure 16:
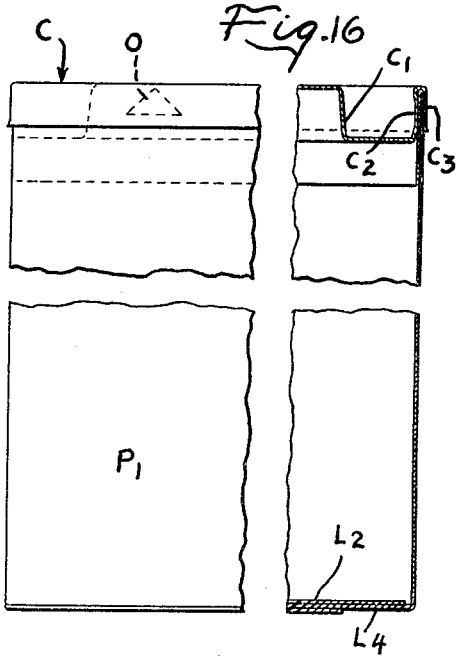
FIG. 16 is a side view of a completed package with parts shown in section.

The present invention relates to packaging machines of the type which are arranged to take carton blanks that are initially supplied in a flattened condition, erect the carton blank to form a generally rectangular carton, fill the carton and close the carton, and particularly to improvements in packaging machines for erecting, filling and closing cartons of the type shown in FIGS. 15 and 16 and designated generally by the letter X. The carton bodies are formed of paperboard and include opposed side panels P1 and P2 interconnected along fold lines to end panels P3 and P4. Lower closure flaps designated L1–L4 are connected along fold lines to the lower ends of the panels P1–P4 respectively. The lower flaps L1–L4 are foldable inwardly to close the lower end of the carton and can be retained in their closed position in any desired manner, for example by adhesives or by interlocks on the flaps. The upper end of the carton X, however, is open but is preferably reinforced or stiffened by flanges F1–F4 that are folded inwardly and sealed, as by an adhesive, to the inner faces of the panels P1–P4. A separate cover designated C formed of plastic material is provided for closing the upper end of the carton and the cover has a generally rectangular cover portion C1 shaped to span and close the open end of the carton X, and a peripheral rim portion in the form of a downwardly opening narrow channel having inner and outer rim wall portions designated C2 and C3, and shaped to receive the reinforced upper end of the carton. Openings designated O are preferably formed in the reinforcing flange portions F1–F4 at spaced locations therealong, and the adhesive used to secure the flanges to the respective panel is preferably of a pressure sensitive type applied to the inner faces of the panel so as to extend over the openings O. After the cover is applied to the open end of the carton, it is crimped in areas adjacent the locations of the openings O to adhesively bond the cover to the end of the carton. The carton illustrated in FIGS. 15 and 16 and described above was developed by others and itself forms no part of the present invention.

The invention is herein shown applied to a packaging apparatus of the type disclosed in U.S. Pat. No. 3,364,651 issued Jan. 23, 1968 and entitled "Packaging Apparatus" to which reference is hereby made for a more complete disclosure of the construction and operation of that packaging apparatus, including the transfer mechanism for advancing the cartons through the packaging apparatus; and the mechanism for erecting the cartons, filling the cartons, and closing the cartons after they are filled in timed relation with the advance of the cartons. As more fully disclosed in the aforementioned patent, the packaging apparatus includes laterally spaced carton guides 21 and 22 spaced apart a distance to receive the cartons therebetween and for guiding the cartons along a linear path; a transfer mechanism 23 for intermittently advancing cartons in step fashion along the path between the guide rails; a hopper 24 for storing carton blanks in a flattened condition adjacent one end of the lateral carton guides; a carton feeding and erecting mechanism 25 engageable with the end carton in the stack on the magazine to pull the same off the stack and for opening and squaring the carton as it is moved to a carton infeed station adjacent one end of the lateral carton guides; a carton filler apparatus 26 intermediate the ends of the carton guides for filling cartons as they are advanced past a filling station, and a flap folding mechanism 28 for folding the end flaps on the upper end of the carton to close the cartons after they are filled.

Figure 1:
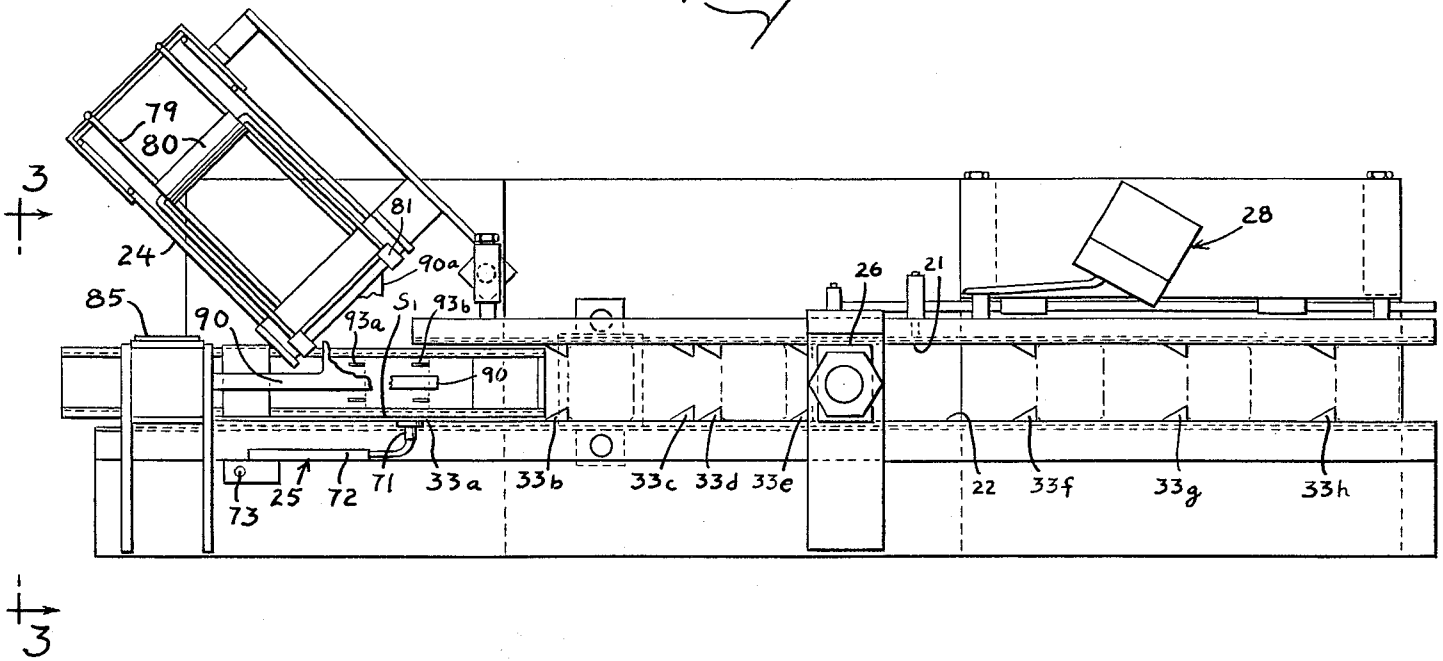
FIG. 1 is a top plan view of a packaging machine embodying the present invention.
Figure 2:
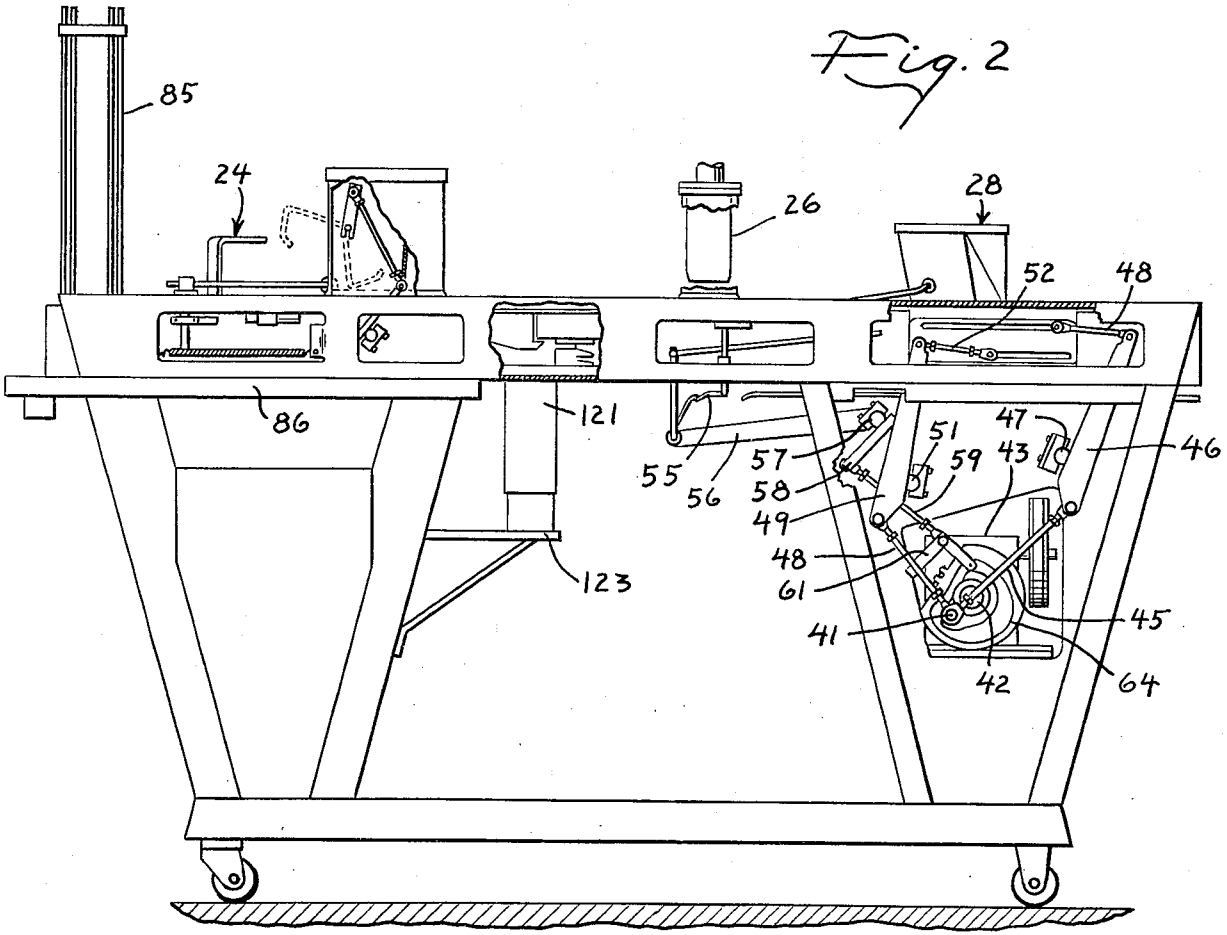
FIG. 2 is a rear elevational view thereof with parts of the housing removed to illustrate parts of the drive mechanism.

The transfer mechanism 23 in the aforementioned patent was of the reciprocating type and included slides 33 mounted for reciprocation along the guides 21 and 22. In that patent the slides were formed in a plurality of slide sections including an inlet slide section that extended from a location adjacent the carton loading station to a location adjacent the filling station, and which had a plurality of carton pushers designated **33*b* and 33*c* in FIG. 1 at spaced locations therealong operative to advance cartons from the loading station to a point advance of the filling; an intermediate slide section mounted for reciprocation in a direction lengthwise of the path adjacent the filling station 33 having carton pushers designated 33*d* and 33*e* in FIG. 1 for moving the cartons into and out of a position at the filling station; and an outlet slide section having a plurality of carton pushers designated 33*f*, 33*g* and 33*h* in FIG. 1 for advancing the filled cartons past the flap folding and end closing mechanism to the delivery end of the packaging apparatus. As disclosed in the patent, the inlet and outlet sections are reciprocated in unison with each other and the intermediate section is reciprocated in timed relation with the inlet and outlet sections but out of phase therewith. As best shown in FIG. 2, the several slide sections are reciprocated by a crank 41 connected to the output shaft 42 of a one revolution clutch 43 driven from a suitable motor (not shown). The crank 41 is connected through a link 45 to one end of a lever 46 that is pivoted intermediate its ends at 47, and with the other end of the lever connected through a link 48 to the inlet and outlet slide sections. The intermediate slide section is driven from the crank 41 through a link 48 connected to one end of a lever 49 that is pivoted at 51 to the frame and which is connected through a link 52 to the intermediate slide section. The one revolution clutch mechanism is arranged to normally stop the crank 41 in the position shown in FIG. 2 and, when the crank is in its stop position, the inlet and outlet slide sections are in their forward position and the intermediate slide section 33*b* is intermediate its forward and rear positions. When the clutch is engaged, it drives the crank through one revolution and back to the position shown in FIG. 2** to thereby reciprocate the inlet and outlet slide sections in timed relation with the intermediate slide section. The multiple slide section transfer mechanism disclosed in the foregoing mentioned patent is advantageous in that it enables rapid acceleration of the filled cartons away from the filling station, while allowing slower acceleration of the cartons from the infeed station to the filling station and from the filling station past the upper flap folding and closing apparatus. However, other carton conveyor mechanism could be utilized and the slides could be formed in a single section as disclosed in U.S. Pat. Nos. 2,612,016 and 3,172,435, if desired.

Figure 6:
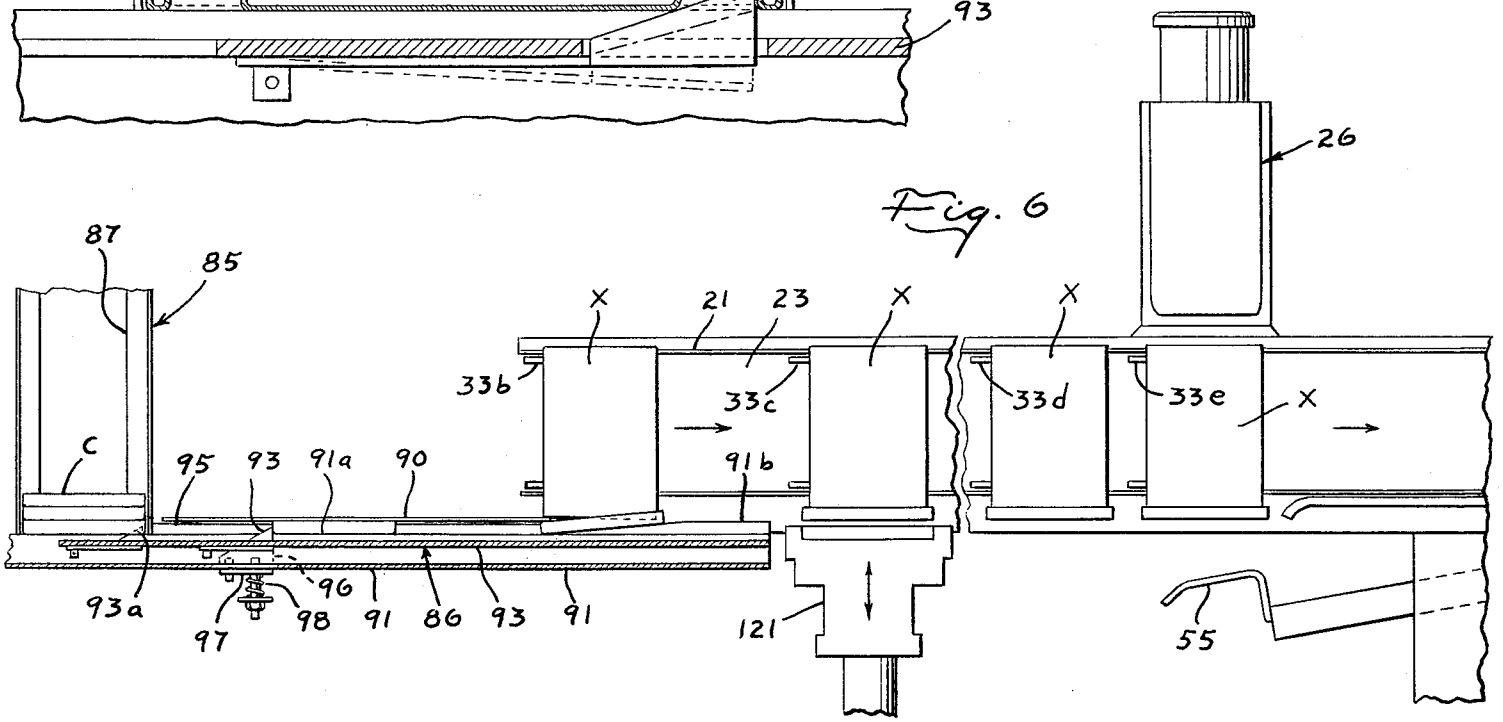
FIG. 6 is a fragmentary vertical sectional view taken on the plane 6—6 of FIG. 5 and illustrating the cover feed and carton feed mechanisms in their retracted positions.

The carton filling mechanism 26 is preferably of the type wherein a semi-fluid or plastic material such as a semi-frozen ice cream, sherbert or the like, is continuously dispensed through a nozzle. In order to avoid interference with the material which continuously emerges from the nozzle, the cartons are advanced to the filling station at a level with the tops of the carton spaced somewhat below the nozzle as shown in FIG. 6 and the cartons are then raised at the filling station by a carton elevator 55. As disclosed in U.S. Pat. No. 3,364,651, the carton elevator 55 is operated in timed relation with the conveyor mechanism and, as best shown in FIG. 2, the elevator 55 is supported on a lever 56 that is swingably supported by a shaft 57 on the frame. An arm 58 is connected to the shaft 57 and through a link 59 to an L-shaped lever 61. One end of the L-shaped lever is pivotally mounted on the frame and a follower is provided on the other end of the lever and engages a cam track on a cam 64 secured to the output shaft 42 of the one revolution clutch. As disclosed in Patent 3,364,651, a switch for actuating the one revolution clutch is operated by the lever 56 when the carton being filled at the filling station moves downwardly to a level in which the top of the carton is adjacent the lower end of the nozzle. The crank 41 operates the intermediate conveyor section to rapidly move a filled carton crosswise of the nozzle and away from the filling station while advancing a succeeding carton to the filling station. When the succeeding carton is moved into position below the nozzle, the cam 64 operates the carton elevator 55 to raise the carton into a least partial telescoping relation to the nozzle.

Figure 5:
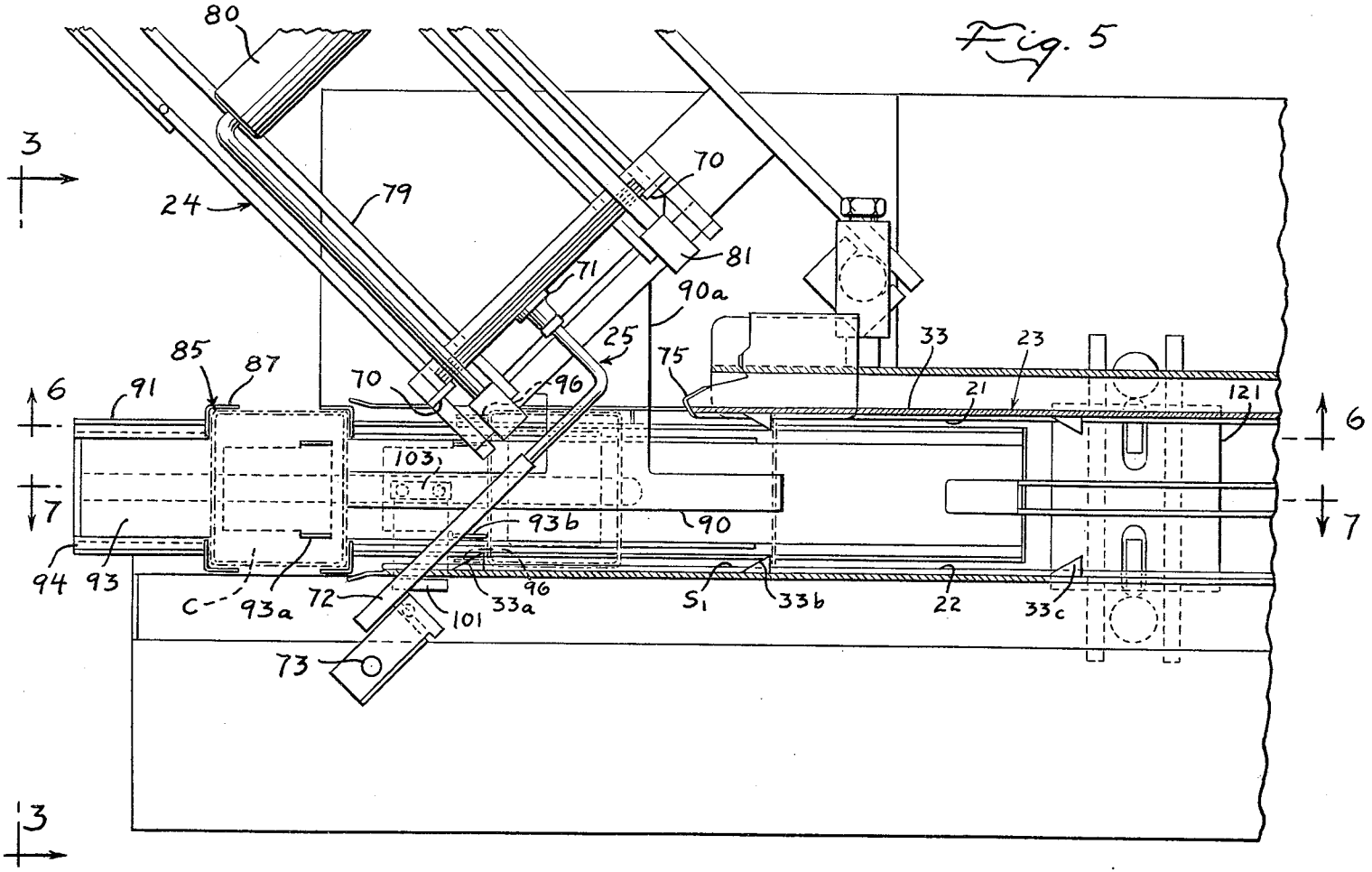
FIG. 5 is a fragmentary horizontal sectional view taken on the plane 5—5 of FIG. 3 and illustrating the parts on a larger scale than FIG. 3 with the cover feed mechanism in its retracted position.

The carton feed mechanism 25 is also conveniently of the type disclosed in the aforementioned U.S. Pat. No. 3,364,651 and is operated in timed relation with the operation of the conveyor mechanism in a manner disclosed in that patent. The feed mechanism 25 includes vacuum operated grippers 71 mounted on arms 72 secured to an upright shaft 73 for swinging movement between a retracted position as shown in FIG. 1 in which the vacuum cups are disposed adjacent the plane of the lateral carton guides 22 and an extended position as shown in FIG. 5, in which the vacuum cups engage the end carton in the magazine. As shown in FIGS. 1 and 5, the magazine supports a stack of flattened cartons with the end carton in the stack offset from the path defined by the lateral carton guides 21 and 22 and at an acute angle relative to the path such that the face of the vacuum cup generally parallels the end face of the carton when it contacts the carton as shown in FIG. 5. When the vacuum cups are swung back to the position shown in FIG. 1, they pull the end carton off the stack and a means including carton stop fingers 70 at the mouth of the magazine and a cam 75 on the end of the guide rail 21 engage the carton to aid in opening and squaring the carton as it is moved to the carton infeed station designated S1.

In accordance with the present invention, carton blanks X of the type shown in FIGS. 15 and 16 having an open top and a separate cover C for closing the open top, are erected in an inverted condition with the open top disposed downwardly, and the covers are applied to the inverted but empty carton. The cartons are thereafter filled while in an inverted condition, and the lower closure flaps thereafter folded to close the bottom of the carton while the carton is still in an inverted condition.

Figure 3:
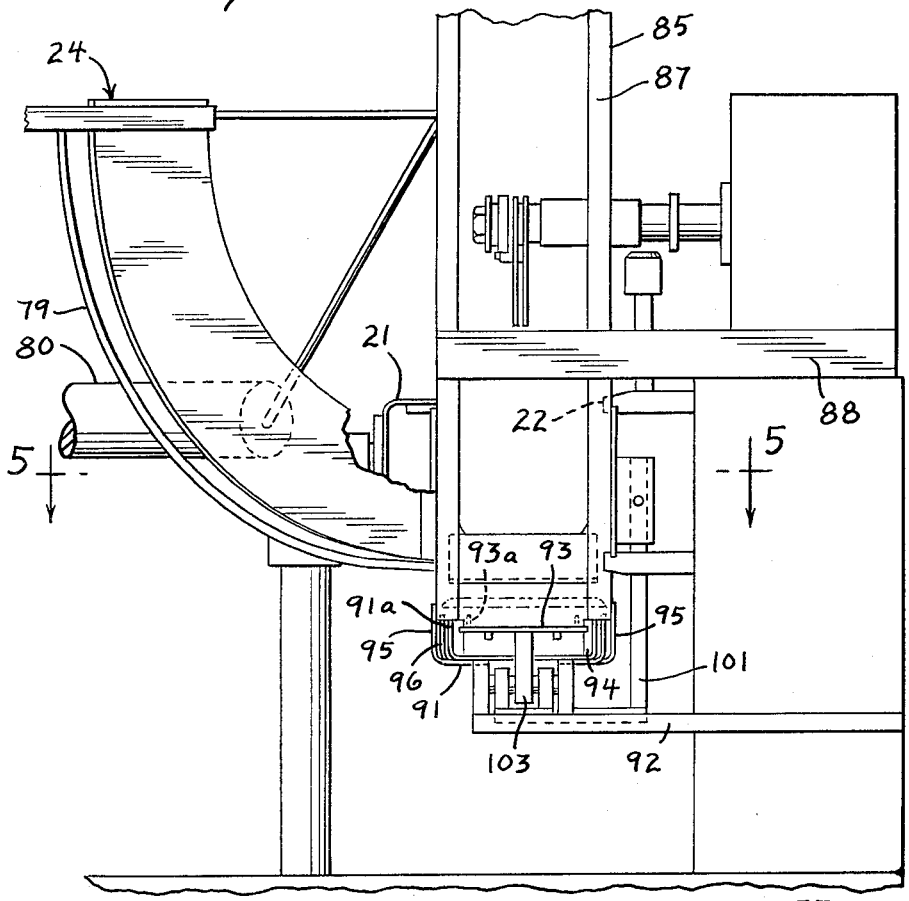
FIG. 3 is an end elevational view taken on the plane 3—3 of FIG. 1.

The carton magazine 24 is modified somewhat from that disclosed in Patent 3,364,651 so as to support the open top carton blanks X in an inverted condition, and the carton feed mechanism 25 operates to deposit the cartons in an inverted condition at the carton infeed station S1. Since the cartons X have flanges designated F1–F4 adjacent the open end of the carton, the open end of the carton is somewhat thicker than the remainder of the carton. As best shown in FIG. 3, the carton magazine 24 is advantageously formed with lower carton support rails 79 which are curved as viewed in a plane perpendicular to the mouth of the carton magazine, to accommodate the difference in thickness of the carton adjacent their open ends. The cartons are conveniently yieldably urged toward the mouth of the magazine by a weighted carton engaging member 80 that is swingably supported as at 81 for movement about an axis concentric with the curve of the magazine carton support rails.

Figure 4:
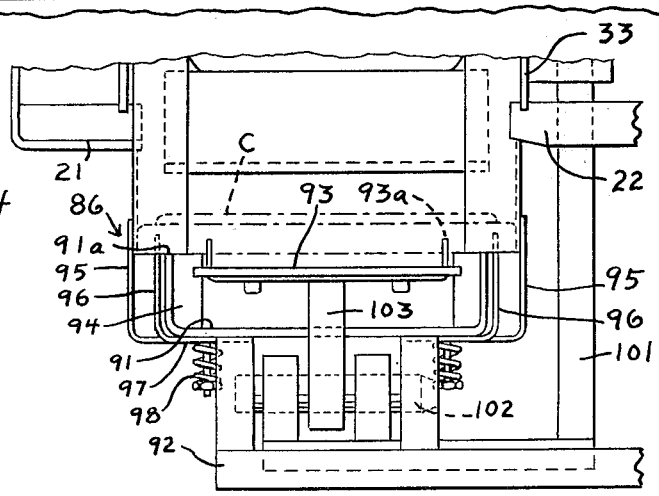
FIG. 4 is a fragmentary enlarged end elevational view taken on the plane 3—3 of FIG. 2.
Figure 7:
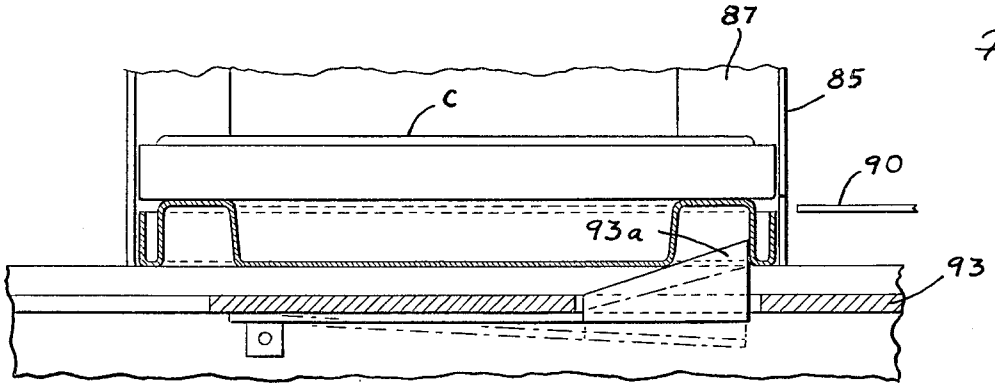
FIG. 7 is a fragmentary vertical section through the cover magazine and hopper and illustrating parts on a larger scale than FIG. 6.
Figure 8:
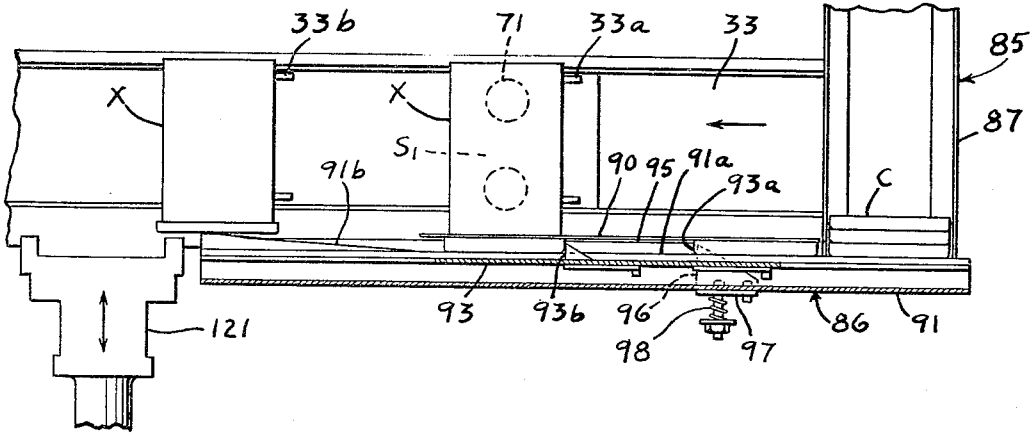
FIG. 8 is a fragmentary vertical sectional view taken on the plane 7—7 of FIG. 5 and illustrating the cover feed and carton feed mechanisms in an intermediate position.
Figure 9:
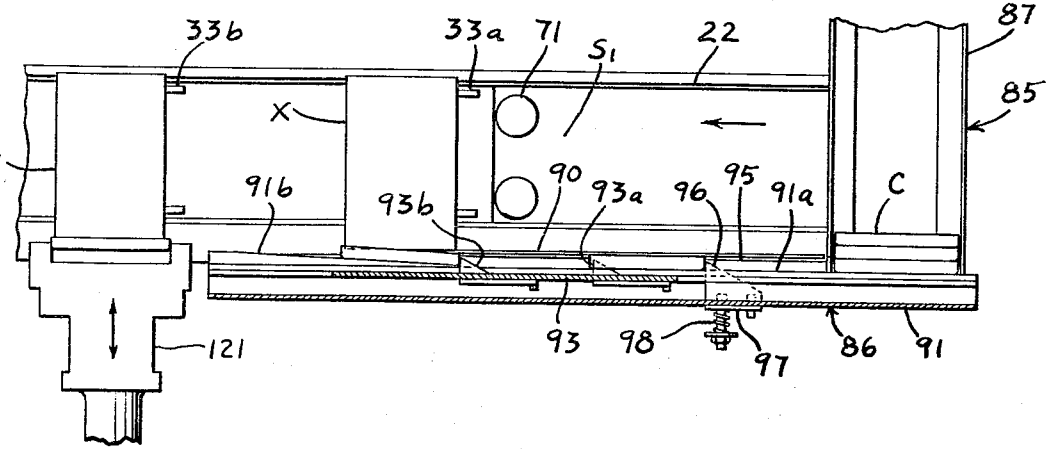
FIG. 9 is a fragmentary vertical sectional view taken on the plane 7—7 of FIG. 5 and illustrating the cover feed and carton feed mechanisms on a larger scale and in their forward position.

A cover magazine 85 is supported adjacent one end of the carton guides for supporting a stack of the covers C, and a cover feeding and applying mechanism 86 is arranged to withdraw covers from the cover magazine and to feed and apply them to the open end of the carton body to close the lower end of the carton body as the carton body is advanced by the carton conveyor mechanism 23. As best shown in FIGS. 1 and 5, the cover magazine 85 is arranged to support the end cover in the stack at a location spaced from the carton infeed station S1, in a direction along the centerline of the path defined by the lateral carton guides 21 and 22. The cover magazine 85 includes cover magazine guides 87, conveniently in the form of vertically extending rails disposed at the corners of the magazine, and supported as by brackets 88 on the frame of the packaging machine. A horizontal cover guide 91, conveniently in the form of an upwardly opening channel, is supported as by brackets 92 on the packaging machine frame to extend below the cover magazine 85 and past the carton infeed station S1. The channel shaped cover guide 91 provides cover support rails along its upper edges which are spaced apart a distance less than the width of the cover to underlie and support the cover as shown in FIGS. 3 and 4. The cover support rails formed by the upper edges of the carton guide 91 have rail portions **91*a* that extend generally horizontally at a level below the lower end of a carton at carton infeed station S1, and upwardly inclined outlet rail portions 91*b* that converge in the direction of advance of the cartons by the carton conveyor mechanism 23, to press the covers upwardly until the rim portions of the covers mate with the open ends of the cartons. As best shown in FIGS. 8 and 9, the rail portions 91*a* extend from below the cover magazine to a point just beyond the carton infeed stations S1, and the outlet rail portions 91*b* are inclined upwardly from rail portions 91*a*. A cover slide 93 is mounted in ways 94 for reciprocation in a direction lengthwise of the cover guide 91. A first set of cover pushers 93*a* are provided on the slide 93 to engage the lowermost cover in the magazine 85 and move the lowermost cover off the magazine to a cover infeed station. A second set of cover pushers 93*b* are provided on the slide 93 to advance the covers from the cover infeed station and along the rail portions 91*a* and 91*b* until the rim on the cover interfits with the open end of the carton being advanced by the carton conveyor mechanism 23. The pushers 93*a* and 93*b* are mounted on the slide 93 for limited movement in a direction crosswise of the slide as best shown in FIG. 7. The pushers 93*a* and 93*b* are resiliently biased by a spring (not shown) to a raised position relative to slide 93 as shown in FIGS. 6–9 to engage a cover supported on rail portions 91*a* and 91*b* during forward movement of slide 93, and have inclined rear faces to cam the cover pushers downwardly and by-pass the covers, when the slide 93 is retracted. Lateral cover guides 95 are mounted on the cover guide 91 and are disposed outwardly of the cover guide rails and project to a level above the cover guide rails to laterally guide the covers. Cover stop fingers 96 are provided to hold a cover advanced by the cover pushers 93*a*, against backward movement during the retraction of the slide 93. As best shown in FIG. 8, the cover stop fingers are located along the cover guide 91 at a location to engage the trail edge of a cover advanced by pusher fingers 93*a* when the slide is moved to its forward position. As shown in FIGS. 3 and 4, the cover stop fingers 96 are disposed outwardly of the cover guide rails 91*a* and inwardly of the lateral cover guides and have mounting portions 97 that underlie the cover guide 91. The cover stops 96 are yieldably urged as by light springs 98 to a raised position in which they project above the cover guide rails 91*a*; and the stops have ramp portions at the inlet side as shown in FIG. 9 so that the stops are cammed downwardly as a cover is advanced by the pusher 93*a*** past the cover stops.

As best shown in FIGS. 3–5, the cover transfer slide 93 is connected to the inlet slide section 33 of the carton transfer mechanism for reciprocation in unison therewith by a generally L-shaped bracket 101 having its upper end connected to the slide section 33 and its other end connected through a pin 102 to a member 103 that extends upwardly through a slot in the cover guide 91 and which is connected to the slide 93. Preferably, the pusher 93*a* is located along the slide 93 so as to engage the rim portion on the lowermost inverted cover in the magazine, when the slide is moved to its retracted position shown in FIG. 6, and to advance the cover off the lower end of the stack to the cover infeed station when the cover slide 93 is moved to its extended position shown in FIG. 9. The second cover pusher 93*b* is preferably arranged to engage the trailing edge of the cover at the cover infeed station, when the slide 93 is retracted as shown in FIG. 6 and to move the cover from the cover infeed station past the carton infeed station S1 as shown in FIG. 8 and to position along the inclined portion 91*b* of the cover guide rails, when the slide 93 is extended as shown in FIG. 9. As shown in FIGS. 5 and 7–9, a thin cover hold down strap 90 is provided to extend from the cover magazine 85 to a location somewhat beyond the carton infeed station S1, to hold the covers down as they are advanced along the portions 91*a* of the cover guide rails, and a container guide portion 90*a* extends laterally of the hold down strap 90 to the bottom of the cover magazine, to guide the lower ends of the cartons from the magazine to the carton infeed station.

Operation of the carton infeed mechanism 25 is timed so as to swing the vacuum cups 71 into engagement with the end carton in the stack on the carton magazine 24 when the inlet slide section 33 is retracted and to swing back to a position alongside the lateral carton guide 21 as shown in FIGS. 8 and 9 during initial forward movement of the inlet slide section. The inlet slide section 33 has one set of the carton pusher finger 33*a* at a location therealong to engage a carton at the carton infeed station S1, when the cover pushers 93*b* advance a cover to a position in which the rim on the cover is in registry with the open lower end of the carton,, so that the carton pushers 33*a* and the cover pusher 93*b* thereafter advance the carton and cover in unison along the path. The converging portions 91*b* of the cover guide rail extend forwardly along the carton path from the carton infeed station S1 and press the cover upwardly until the rim on the cover interfits with the open lower end of the carton. The cartons and covers continue advance in unison until the inlet carton slide section 33 and the cover slide 93 reach the forward end of the stroke as shown in FIG. 9. At that time, the one revolution clutch 43 interrupts the drive of the carton transfer mechanism until another carton is filled at the filling station. The pusher fingers 33*b* on the inlet conveyor section 33 are spaced from the fingers 33*a* a distance corresponding to the stroke of the inlet slide section 33, and carton pushers 33*b* operate to advance the cartons with the covers applied to a succeeding station.

Figure 10:
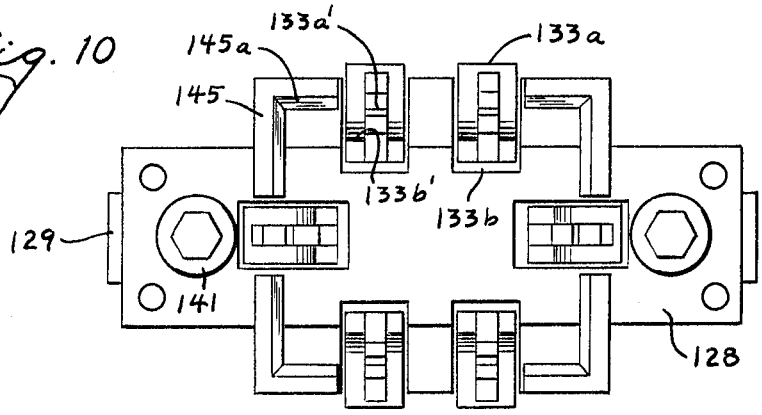
FIG. 10 is a top plan view of the cover crimper mechanism illustrating the parts on a larger scale.
Figure 11:
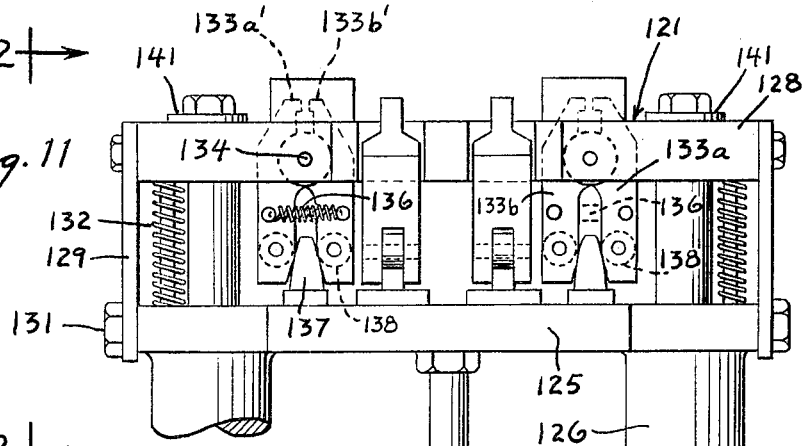
FIG. 11 is a side elevational view of the cover crimper mechanism.
Figure 12:
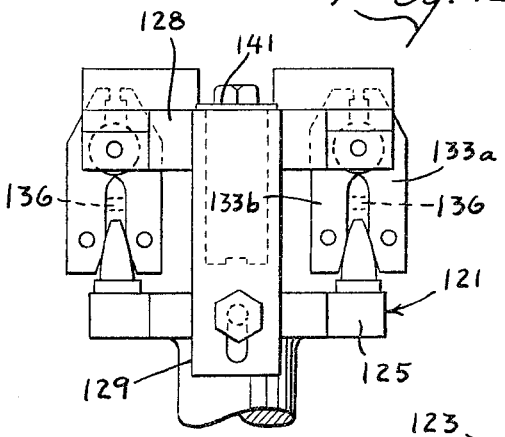
FIG. 12 is an end elevational view of the cover crimper mechanism.
Figure 12:
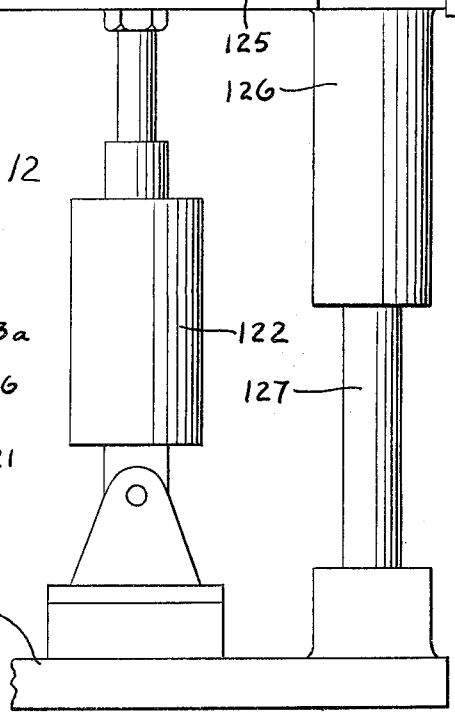
Figure 13:
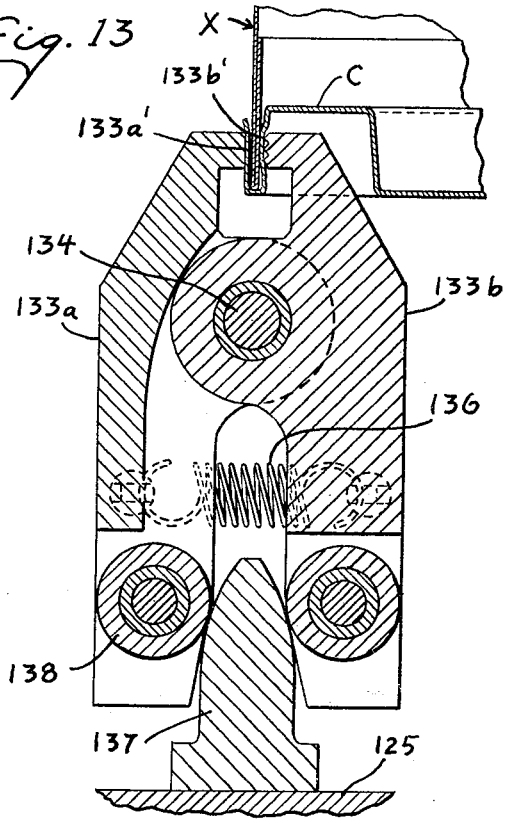
FIG. 13 is a fragmentary view illustrating the cover crimp jaw in operation, illustrating the parts on a larger scale than FIGS. 10–12.
Figure 14:
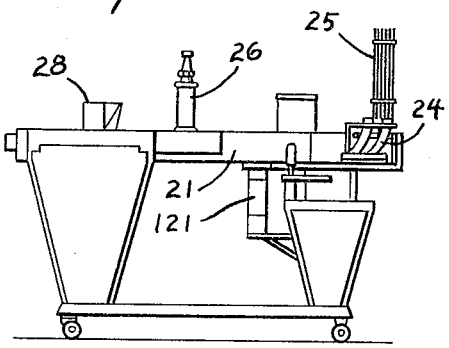
FIG. 14 is a front elevational view of the packaging machine.

In cartons of the type shown in FIGS. 15 and 16, the carton manufacturer recommends crimping of the cover rim to the open end of the carton body to retain the cover on the open end of the carton at least until the product such as ice cream has solidified in the carton. A cover crimping head 121 is accordingly provided intermediate the carton infeed station and the filling station for crimping one cover rim to the end of the carton. The cover crimping head 121 is raised and lowered into and out of engagement with the cover on the open end of the carton body in timed relation with operation of the carton transfer mechanism as by a fluid cylinder 122 (FIG. 11) supported as by a bracket 123 on the packaging machine frame. The cylinder is operated in timed relation with the carton transfer mechanism 23 as by a suitable valve (not shown), to elevate the head into engagement with the cover on a carton at the crimping station, when the transfer mechanism is stopped at the forward end of its stroke, and to lower the head out of the path of the covers and cartons, when the cartons are being advanced by the carton transfer mechanism. An improved cover crimping mechanism is illustrated in FIGS. 10–13. The cover crimping mechanism includes a lower head 125 slidably mounted as by guides 126 on upright rods 127, and an upper head 128 also slidably mounted on the rods 127. The heads 125 and 128 are supported for limited loss motion relative to each other as by straps 129 attached to the head 128 and having slotted lower ends that are slidably connected by bolts 131 to the lower head 125. Springs 132 are interposed between the upper and lower heads to yieldably urge the upper head upwardly relative to the lower head 125. A plurality of pairs of crimping jaws 133*a*, 133*b* are pivotally mounted intermediate their ends by pins 134 on the upper head 128, at spaced locations therearound corresponding to the periphery of the rim portion of the cover C. As shown in FIG. 13, the crimping jaws 133*a* and 133*b* respectively have faces 133*a*′ and 133*b*′ arranged to engage the inner and outer portions of the rim on the cover. The jaws of each pair are yieldably urged to an open position by a spring 136, and the jaws of each pair are positively urged to their closed position by wedge members 137 mounted on the lower head 125. Each wedge member 137 is arranged to engage followers 138 on the lower ends of a respective pair of the jaw members 133*a* and 133*b*. When the cylinder 172 is extended, the upper and lower heads 128 and 125 move upwardly in unison until the upper head engages stops 141 on the upper ends of the rod 127. The lower head 125 continues upward movement and forces the wedge members 137 between the followers 138 to thereby close the jaws 133*a* and 133*b* and crimp the cover rim to the end of the carton as shown in FIGS. 11–13. Preferably, the opposed crimping jaws are arranged on the upper head at locations to crimp the rim on the cover to the carton at points corresponding to the openings O in the flanges F1–F4 on the open end of the carton. This presses the inner side of the rim against the adhesive on the cartons that is exposed by the openings O to secure the cover rim to the carton. When cylinder 122 is retracted, the lower head 125 moves downwardly to retract the wedges 137 and open the jaws, and the upper head 128 thereafter moves downwardly to move the jaws out of the path of movement of the cartons. As best shown in FIG. 10, crimping head locators 145 of generally L-shaped configuration are provided on the upper head and have beveled faces 145*a* for engaging cover adjacent its corner to center the head 121 relative to the cover.

The pusher fingers 33*c* on the inlet conveyor section are arranged to advance an empty container from the crimping station to a position in advance of the filling station. As described more fully in the aforementioned Patent 3,364,651, the intermediate conveyor section has fingers 33*d* and 33*e* which are arranged to advance an empty carton to the filling station while advancing a filled carton away from the filling station, and the outlet conveyor section has pusher fingers 33*f*, 33*g* and 33*h* which are arranged to advance the cartons in step fashion past the mechanism 28 for closing the lower flaps on the carton. The mechanism for closing the lower flaps L1–L4 will vary with the type of flap closure and flap securing means that are utilized on the carton and may, for example, be of the type disclosed in Patent 3,364,651. The lower closure flaps may be secured in their closed condition by an adhesive applied either before or during the flap closing operation. Alternatively, some of the flaps can be the interlocking type flaps as disclosed in U.S. Pat. No. 2,612,016.

From the foregoing it is thought that the construction and operation of the packaging apparatus will be readily understood. The carton feeding mechanism 25 withdraws cartons from the end of the stack in the magazine and opens and erects the cartons and deposits the cartons in an inverted condition at the carton infeed station between the lateral carton guides 21 and 22. The cover feed mechanism 86 feeds covers from the magazine along a path below the cartons at the carton infeed station and, when the cover is advanced to a position in which the cover rim registers with the open lower end of the carton, the cover and carton are thereafter advanced in unison by the carton pusher fingers 33*a* and the cover pusher fingers 93*a*, and the covers are simultaneously caused to converge relative to the open end of the carton to press the rim on the cover onto the lower end of the carton. The cartons and covers are thereafter advanced by carton pushers 33*b* to the crimping station where the rims on the covers are crimped to the open ends of the cartons and carton pusher fingers 33*c* operate to advance a carton from the crimping station to a location in advance of the filling station. Carton pushers 33*e* and 33*d* operate to move a filled carton away from the filling station and to advance a succeeding carton to the filling station where the cartons are filled. Pusher fingers 33*f*, 33*g* and 33*h* continue advance of the filled cartons along the path and the lower closure flaps L1–L4 are thereafter folded to close the carton. Since the covers are applied to the carton before they are filled, interference with the product during applying the cover and in sealing the cover to the carton is avoided. In addition, since the cartons are filled in an inverted condition, void spaces at the top of the carton are effectively eliminated.

The embodiments of the invention in which an exclusive property or privilege is claimed are defined as follows:

1. In a packaging apparatus for erecting, filling and closing cartons initially supplied in a flattened condition and having four body panels interconnected along fold lines to form a rectangular carton body; bottom closure flaps interconnected along fold lines to the lower ends of the four body panels for closing the bottom of the carton body; an open top; and a separate cover of rectangular configuration for closing the open end of the carton body and preformed with a marginal rim portion around the cover, the packaging apparatus being of the type having a filling station, spaced lateral carton guides for guiding the carton bodies along a linear path past the filling station, conveyor means operative to advance carton bodies along said path from a carton infeed station adjacent one end of the lateral carton guides and past said filling station to a delivery station, a carton magazine adjacent one end of said lateral carton guides for supporting a stack of flattened carton bodies, carton feed means operated in timed relation with said conveyor means for withdrawing a flattened carton body from the carton magazine and for opening the carton body and for depositing the opened carton body at said carton infeed station, the improvement wherein the carton magazine and carton infeed mechanism are arranged to deposit the carton bodies at the infeed station with the carton body inverted to have its open end lowermost, a cover magazine adjacent said one end of said lateral carton guides for supporting a stack of covers, means operated in timed relation with said conveyor means for feeding a cover from the cover magazine to a cover infeed station at a level below said carton infeed station, cover applying means operated in timed relation with said conveyor means for moving a cover from said cover infeed station and into the open end of a carton body to close the same as the carton body is advanced by the conveyor means away from the carton infeed station toward the filling station, and means disposed above said path for folding and closing the carton bottom closure flaps as the cartons are advanced by the conveyor means from the filling station to the delivery station.

2. A packaging apparatus according to claim 1 wherein said cover applying means includes means for advancing a cover from said cover infeed station along a cover path below and in relatively converging relation with a carton body as it is advanced by the conveyor means.

3. A packaging apparatus according to claim 1 wherein said conveyor means includes a carton transfer slide along at least one side of said path adjacent said inlet station and mounted for reciprocation in a direction paralleling said path, said carton transfer slide having carton body engaging means for engaging and advancing a carton body from the carton infeed station along the path when the transfer mechanism is moved forwardly and for bypassing the carton body when the transfer mechanism is moved in the other direction, said cover applying means including a cover transfer slide mounted below said path adjacent said carton infeed station for reciprocation in a direction paralleling said path and having cover engaging means for advancing a cover when the cover transfer slide is moved forwardly, and means connecting said cover transfer slide to said carton transfer slide for reciprocation therewith.

4. A packaging apparatus according to claim 3 wherein said cover applying means includes a ramp along the path of movement of a cover by said cover transfer slide for guiding a cover in converging relation to the open end of the carton.

5. A packaging apparatus according to claim 3 wherein said cover engaging means is arranged to engage the cover rim adjacent the lead side of the cover.

6. A packaging apparatus according to claim 3 wherein the cover magazine is arranged to support the stack of covers with the end cover in the stack at a level below said path and at a location spaced along the centerline of the path from said carton infeed station, said cover feed means including means on said cover transfer slide for engaging the end cover in the cover stack to move the end cover off the stack and to said cover infeed station.

7. A packaging apparatus according to claim 1 wherein the carton magazine is arranged to support the stack of flattened cartons with the end carton in the stack offset laterally from said path adjacent said carton infeed station, the cover magazine being arranged to support the stack of covers with the end cover in the stack disposed at a level below said path and at a location spaced from the carton infeed station along a projection of said carton path, a cover transfer member extending from the cover magazine past said carton infeed station and mounted for reciprocation in a direction paralleling said path, said cover feed means including means on said cover transfer member for engaging the end cover in the cover stack to move the end cover off the stack to said cover infeed station said cover applying means including means on said slide for engaging a cover at the cover infeed station and for moving that cover into the open end of the carton body.

8. A packaging apparatus according to claim 1 including a cover securing head below said path at a cover securing station spaced along said path from the carton infeed station, means operative in timed relation with said conveyor means for elevating said head into engagement with the cover on a carton body at said cover securing station, and means on the cover securing head for securing the rim portion on the cover to carton body panels at spaced locations therearound.

9. A packaging apparatus according to claim 8 wherein said last mentioned means includes a plurality of pairs of relatively movable jaw members on said head adapted to crimp the cover rim on the carton body panels, and wedge menas for relatively moving the jaw members of each pair.

10. In a packaging apparatus for erecting, filling and closing carton bodies initially supplied in a flattened condition and having four body panels interconnected along fold lines to form a rectangular carton body; bottom closure flaps interconnected along fold lines to the lower ends of the four body panels for closing the bottom of the carton body; an open top; and a separate cover of rectangular configuration for closing the open end of the carton body and preformed with a marginal rim portion around the cover, the packaging apparatus having a filling station, spaced lateral carton guides for guiding carton bodies along a linear path from a carton infeed station adjacent one end of the lateral carton guides and past the filling station to a delivery station, a carton transfer means mounted for reciprocation in a direction generally paralleling said path and having carton body engaging means at spaced locations therealong for engaging and advancing a carton body therewith when the transfer means is moved in a forward direction and for by-passing the carton bodies when the transfer means is retracted, a carton magazine for supporting a stack of cartons with the end carton in the stack offset to one side of said carton infeed station, carton feed means operated in timed relation with said carton transfer member for withdrawing a flattened carton body from the carton magazine and for opening the carton body and for depositing the opened carton body at the carton infeed station, the improvement wherein the carton magazine and carton infeed mechanism are arranged to deposit the carton bodies at the carton infeed station with one carton body inverted to have its open end lowermost, a cover magazine for supporting a stack of covers with the end cover in the stack disposed at a level below said path and at a location spaced from the carton infeed station along a projection of said carton path, cover guide means underlying the end cover in the stack and extending therefrom past the carton infeed station, cover transfer mechanism mounted for reciprocation in timed relation with the carton transfer means, means on the cover transfer mechanism for moving the end cover off the cover magazine and along a path below the carton infeed station, means on the cover guide means for guiding the cover into the open end of a carton body as the latter is advanced by the carton transfer means from the carton infeed station toward the filling station, and means disposed above said path for folding and closing the carton bottom closure flaps as the cartons are advanced from the filling station to the delivery station.

11. A packaging apparatus according to claim 10 including a cover securing head at a cover securing station spaced along said path from said carton infeed station, means operated in timed relation with said carton transfer member for elevating said head into engagement with the cover on a carton body at said cover securing station, and means on the cover securing head for securing the rim portion of the cover to the carton body panels at spaced locations around the rim.

12. A packaging apparatus according to claim 11 wherein said last mentioned means includes a plurality of pairs of relatively jaw members on the head adapted to crimp the cover rim on the carton body panels, and wedge means for relatively moving the jaw members of each air.

* * * * *

UNITED STATES PATENT AND TRADEMARK OFFICE

CERTIFICATE OF CORRECTION

PATENT NO. : 4,259,827

DATED : April 7, 1981

INVENTOR(S) : Roger H. Stohlquist

It is certified that error appears in the above-identified patent and that said Letters Patent are hereby corrected as shown below:

Claim 7, column 11, line 10, a comma should be inserted after the word "station";

Claim 12, column 12, line 46, "air" should be -- pair --.

Signed and Sealed this

*Thirtieth* Day of *June 1981*

[SEAL]

*Attest:*

RENE D. TEGTMEYER

*Attesting Officer*

*Acting Commissioner of Patents and Trademarks*